United States Patent [19]

Waters

[11] Patent Number: 4,817,258

[45] Date of Patent: Apr. 4, 1989

[54] KEY ORIENTATION AND SEATING TOOL

[75] Inventor: Mark H. Waters, Harrisburg, Pa.

[73] Assignee: AMP Incorporated, Harrisburg, Pa.

[21] Appl. No.: 90,292

[22] Filed: Aug. 31, 1987

[51] Int. Cl.[4] ..... B25B 27/14

[52] U.S. Cl. ..... 29/240; 29/271

[58] Field of Search ..... 29/270, 271, 278, 741, 29/759, 739, 758, 240

[56] References Cited

U.S. PATENT DOCUMENTS

| | | | |
|---|---|---|---|
| 1,453,913 | 5/1923 | Burdick | 29/271 |
| 2,774,133 | 12/1956 | Sitz . | |
| 2,960,864 | 11/1960 | Watts . | |
| 3,074,155 | 1/1963 | Cootes et al. . | |
| 3,135,043 | 6/1964 | Anderson et al. | 29/271 |
| 3,135,147 | 6/1964 | Curtis et al. . | |
| 3,235,834 | 2/1966 | O'Keefe et al. . | |
| 3,590,461 | 7/1971 | Siler | 29/240 |
| 3,664,007 | 5/1972 | Schlage | 29/271 |
| 3,725,993 | 4/1973 | Siler | 29/271 |
| 4,558,501 | 12/1985 | Moulin et al. | 29/271 |
| 4,577,919 | 3/1986 | Waters . | |
| 4,674,183 | 6/1987 | Ducret | 81/9.4 |

OTHER PUBLICATIONS

AMP Incorporated Instruction Sheet 1216, Released 11-14-84, pp. 1 and 2.

AMP Incorporated Instruction Sheet 7261, Released 1-28-66.

*Primary Examiner*—Robert C. Watson

*Attorney, Agent, or Firm*—David L. Smith

[57] ABSTRACT

A tool (100) for orienting and seating a programmable key (36) in an electrical connector (10). The tool (100) is designed for use with keying systems (30) which includes a key (36) having an extended keying portion (68), and which is rotatable to position the keying portion (68) at any selected one of a plurality of orientations when the key (36) is partially inserted into a key-receiving passageway (31) in the connector (10), and which is thereafter fully insertable into the passageway (31) to lock the key (36) in the passageway (31) in the selected orientation. The tool (100) comprises a sleeve (101) having a bore (102), a cylindrical member (103) positioned within the bore (102) and including an extended portion (112) at its forward end for defining a space (131) for receiving the extended keying portion (68) or a key (36) when the member (103) is in a retracted first position in the sleeve (101); means for rotating the member (103) while the member (103) is in the retracted first position to rotate the key (36) to a selected orientation when the extended keying portion (68) of the key (36) is received in the space (131); and means (121) for coupling the member (103) to the sleeve (101) while permitting axial movement of the member (103) relative to the sleeve (101) whereby the oriented key (36) is fully inserted into a key-receiving passageway (31) by moving the member (103) axially forward relative to the sleeve (101) to an extended second position.

15 Claims, 4 Drawing Sheets

KEY ORIENTATION AND SEATING TOOL

BACKGROUND OF THE INVENTION

The present invention relates generally to keying systems for electrical connectors, and, more particularly, to a tool for orienting and seating programmable keys in an electrical connector.

Electrical connectors are frequently provided with keying means to permit particular pairs of connectors to properly mate and to prevent the mating of connectors which are not intended to be mated. Keying means are especially useful when a plurality of identical connectors are positioned in close proximity to one another, for example, on a printed circuit board. The incorrect matching of complementary connectors to the connectors on the board can cause serious damage to the circuits improperly connected thereby; and the keying means, by ensuring that each complementary connector will mate with only the correct one of the plurality of connectors on the board, minimizes the risk of improper connection. Keying means are particularly important when the connections are made by untrained personnel as the risk of improper connection is especially great in such circumstances.

Keying systems are known in which a key member is secured in one of a pair of complementary connectors and is adapted to cooperate with an opposing key member secured in the other of the pair of connectors. Each key member is secured in its connector in a selected orientation with respect to its opposing key member so that when the connectors are intended to be mated, extended keying portions on the key members pass by each other during mating to allow the connectors to properly mate. If one of the key members is secured in an incorrect orientation with respect to its opposing key member, however, the extended keying portions on the key members will abut one another during mating to prevent proper mating of the connectors.

One known type of key member is provided with a portion having a polygonal cross-section and is adapted to be secured within a passageway in a connector in a selected orientation. The number of sides of the polygonal shape determines the number of possible orientations of the key member.

Typically, orienting of the key member and positioning and securing the key member in the connector is performed by hand, and is often a time-consuming procedure. Orienting and securing of the key member is particularly troublesome in small connectors, inasmuch as the key member also tends to be quite small and rather difficult to handle.

SUMMARY OF THE INVENTION

The present invention relates to a tool for both orienting and seating a programmable key in an electrical connector. The tool is particularly designed for use with keying systems which include a key having an extended keying portion, and which is rotatable to position the keying portion at any selected one of a plurality of orientations when the key is partially inserted into a key-receiving passageway in the connector, and which is thereafter fully insertable into the passageway to lock the key in the passageway in the selected orientation.

The tool of the invention comprises a sleeve having a bore extending thereinto from a forward end face thereof; a substantially rigid member positioned within the bore and including means at its forward end for defining a space for receiving the extended keying portion of a key; means for rotating the member whereby the key is rotated to a selected orientation when the extended keying portion of the key is received in the space; and means for coupling the member to the sleeve while permitting axial movement of the member relative to the sleeve whereby the key is inserted into a key-receiving passageway by moving the member axially forward relative to the sleeve.

According to a presently preferred embodiment, the sleeve includes a cylindrical bore and the rigid member comprises a cylindrical-shaped member slidable axially within the bore between a first retracted position and a second extended position. While in the retracted position, the extended portion of the cylindrical member defines a generally semi-circular space between a flat, side-facing first bearing surface on the extended portion and the sidewall of the bore. The means for rotating the member includes means for preventing relative rotation between the member and the sleeve whereby upon rotation of the tool with the extended keying portion of the key extending into the space, the first bearing surface on the extended portion of the cylindrical member bears against the extended keying portion of the key to rotate the key to a selected orientation.

The tool preferably includes indicia thereon, for example, on a handle connected to the cylindrical member, for identifying the orientations to which the key is rotated.

The cylindrical member also defines a forwardly facing second bearing surface for pushing the key fully into the key-receiving passageway of a connector after it has been oriented by moving the member from the first retracted position to the second extended position. The cylindrical member is supported in the sleeve by a spring or other resilient means which normally urges the member to its first retracted position.

The tool of the invention comprises a convenient means for both rotating the key to a desired orientation, and for thereafter seating the oriented key in a connector passageway in a locked position. The tool of the invention may comprise a hand tool or a tool adapted to be incorporated into appropriate automated equipment.

Further advantages and specific details of the invention will become apparent hereinafter in conjunction with the following detailed description of a presently preferred embodiment.

DETAILED DESCRIPTION OF THE PREFERRED EMBODIMENT

Figure 2:
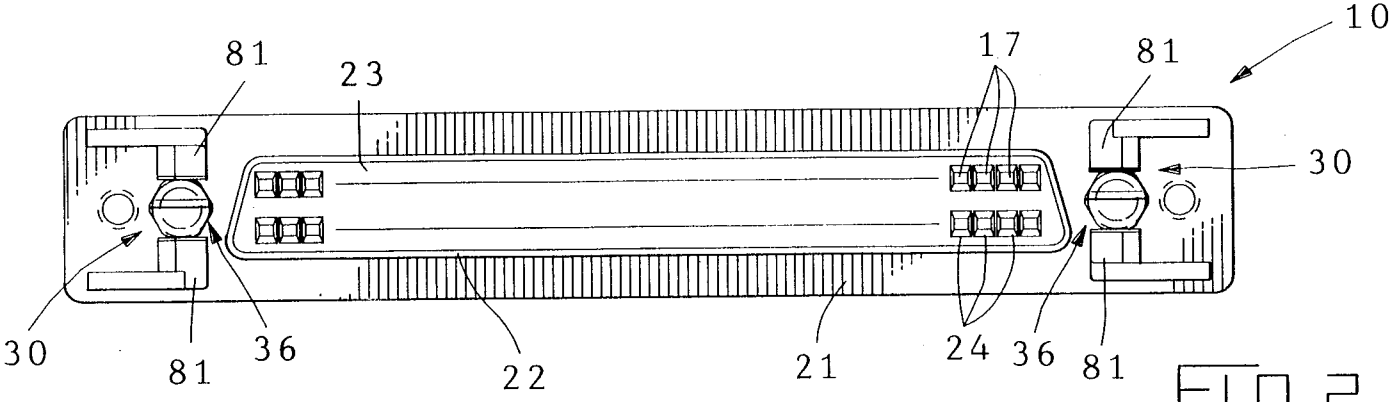
FIG. 2 is a top view of the connector of FIG. 1.

In order to provide a clearer understanding of the invention, FIGS. 1–4 illustrate an electrical connector 10 incorporating a keying system with which the tool of the present invention may be used.

In the embodiment illustrated, connector 10 comprises a receptacle connector adapted to be mounted to a printed circuit board or the like (not shown). Connector 10 comprises a housing 21, a metal shroud 22 supported in a polarizing D-aperture in housing 21, and a plastic header 23 formed of suitable, thermoplastic, insulating material supported within shroud 22. Header 23 has a plurality of passageways 24 extending therethrough for receiving a plurality of female contacts 17.

Connector 10 is adapted to be mated with a complementary electrical connector (not shown) to complete electrical circuits through the connectors as is known to those skilled in the art. Connector 10, however, is particularly designed for use in applications in which a plurality of identical connectors are mounted in close proximity to one another; and in such applications, it is important to ensure that each of the identical connectors be mated with the correct complementary connector as mismatching of connector pairs can result in damage to the electrical circuits improperly connected thereby.

Figure 1:
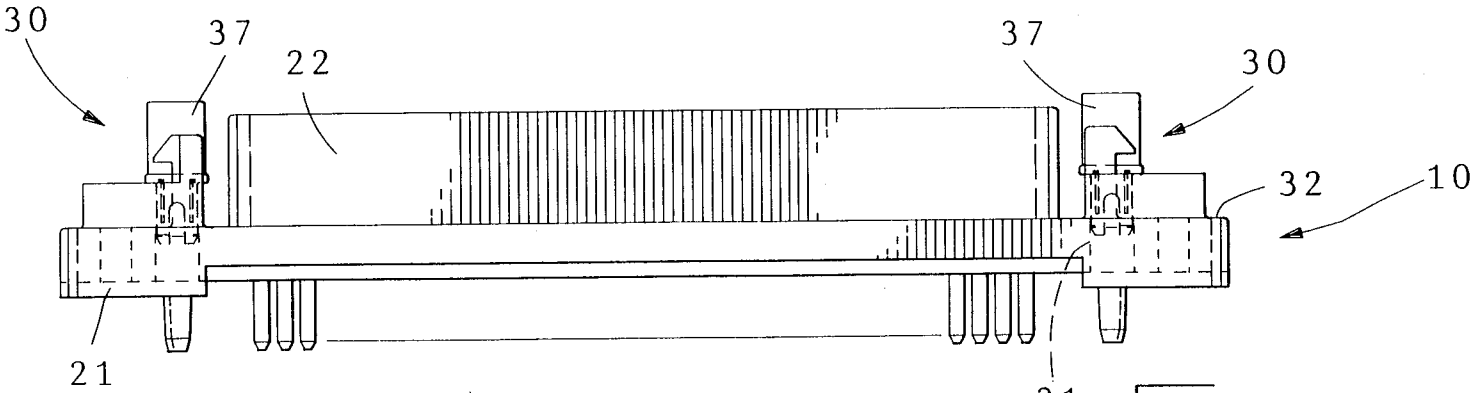
FIG. 1 is a front view of an electrical connector incorporating keying means with which the tool of the present invention may be used.

To ensure that each connector 10 can mate with only the correct complementary connector, the connectors include keying systems to prevent improper connector pairs from being mated; and connector 10 includes a keying system generally designated by reference numeral 30 in FIGS. 1 and 2. As will be explained in greater detail hereinafter, keying system 30 includes a pair of keys 36 which are mounted adjacent opposite ends of connector housing 21 and which include extended keying portions 37 which can be positioned in any selected one of a plurality of orientations. The complementary connector will similarly include a pair of keys having keying portions which are also positioned in a selected orientation.

As is known to those skilled in the art, if keys 36 of connectors 10 are properly oriented with the keys on the complementary connector, keying portions 37 will pass by the keying portions on the keys of the complementary connector as the connectors are mated, permitting the connectors to properly mate. If, however, keys 36 are not properly oriented with respect to the keys on the complementary connector, keying portions 37 will impinge against the keying portions on the keys of the complementary connector during mating to prevent the connectors from being mated. The keying systems thus permit a connector 10 to mate with only the proper complementary connector and not with an incorrect complementary connector.

Figure 4A:
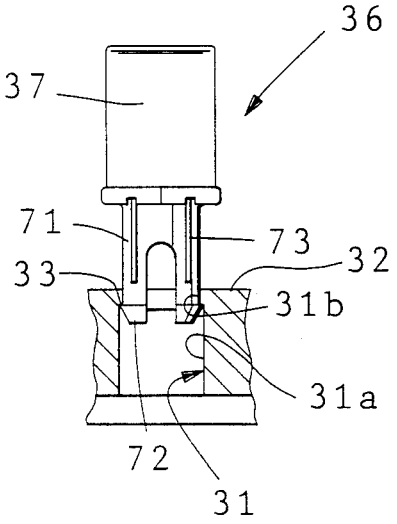
FIGS. 4A and 4B are cross-sectional views looking in the direction of arrows 4A—4A and 4B—4B in FIGS. 3A and 3B, respectively, illustrating the key in programmable and locked positions, respectively.
Figure 4B:
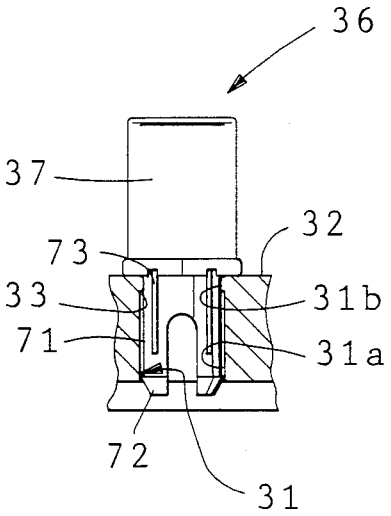

As best shown in FIGS. 4A and 4B, housing 21 includes a pair of key-receiving passageways 31 adjacent opposite ends thereof. Passageways 31 extend into housing 21 from upper surface 32 thereof and include a first, lower passageway portion **31*a* and a second, upper passageway portion 31*b* of slightly reduced diameter. Passageway portion 31*b* is positioned adjacent the entrance to passageway 31, and defines with passageway portion 31*a*, an internal annular shoulder 33 therebetween (see FIG. 4B**).

Figure 5:
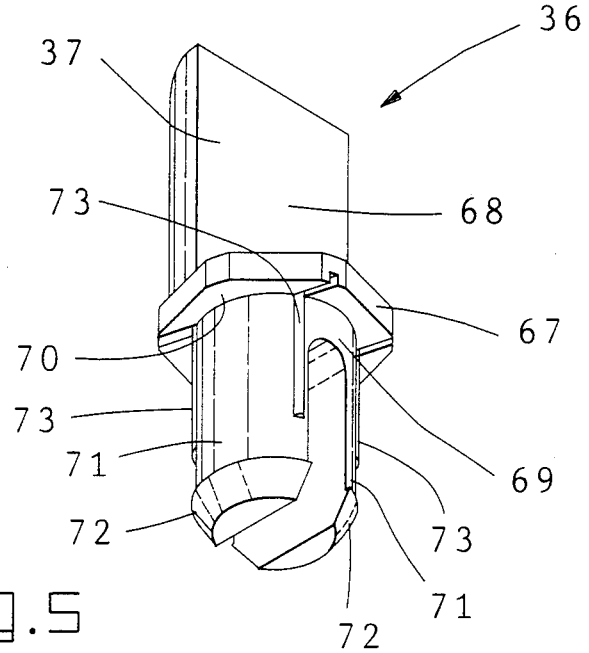
FIG. 5 is a perspective view of the key used in the connector of FIGS. 1–4.

Key-receiving passageways 31 are adapted to receive a pair of keys 36. Key 36 is illustrated in detail in FIG. 5 and comprises a generally elongated member having a body portion 67, a keying portion 68, and a retention portion 69. Body portion 67 is formed to have a cross-section shaped in a regular polygonal shape, preferably, a hexagonal shape, to define the different orientations of key 36. Keying portion 68 is of generally semi-circular cross-section, and extends upwardly from body portion 67, covering approximately one-half of the upper surface of body portion 67.

Retention portion 69 extends downwardly from the lower surface 70 of body portion 67 and comprises a pair of downwardly extending legs 71, each of which has a small projection or barb 72 extending outwardly from the lower end thereof. Retention portion 69 also includes a plurality of, e.g., four, spaced, outwardly extending longitudinal ribs 73 formed around a ribbed section thereof.

Figure 3A:
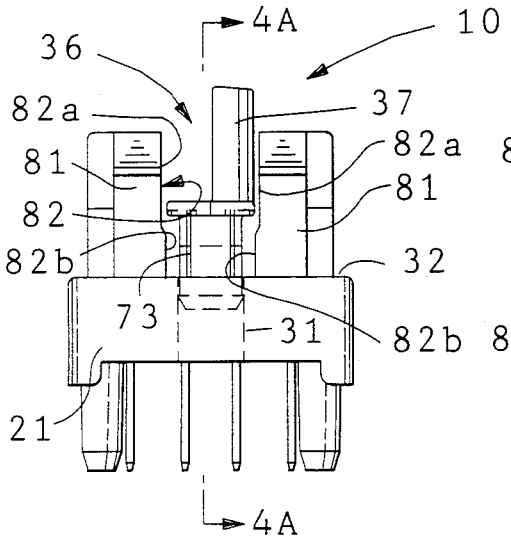
FIGS. 3A and 3B are side views of the connector of FIGS. 1 and 2 illustrating a key in programmable and locked positions, respectively.
Figure 3B:
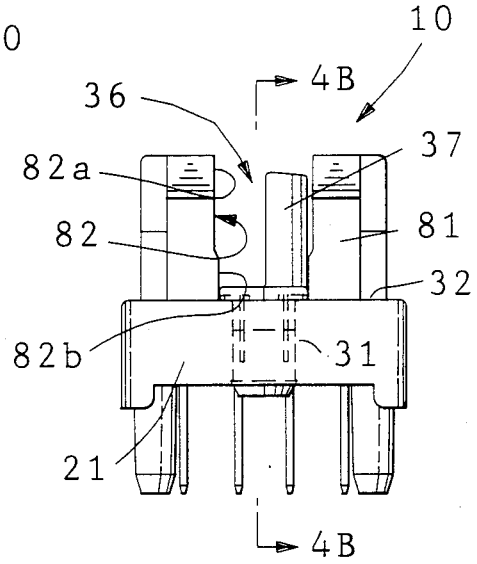

Housing 21 is also provided with a pair of key location features 81 which extend upwardly from upper surface 32 of housing 21 and which are positioned on diametrically opposed sides of each key-receiving passageway 31. Key location features 81 have facing internal surfaces 82 which are parallel to one another and which include a first upper surface portion **82*a* and a second lower surface portion 82*b*. As can be seen in FIGS. 3A and 3B, lower surface portions 82*b* are stepped inwardly from surface portions 82*a* to define a reduced spacing between parallel surface portions 82*b* on opposed key location features 81**.

A key 36 is adapted to be inserted into and retained within each of key-receiving passageways 31 of connector 10. More particularly, keys 36 are adapted to be first inserted into and retained within passageways 31 n a programmable first position in which the keys are partially inserted into and rather loosely retained within passageways 31 such that they are capable of being rotated to orient the keying portions of the keys to any selected one of a plurality of desired orientations; and thereafter seated into a locked second position in which the keys are fully inserted into the passageways to lock the keys in the selected orientation. FIGS. 1, 3A, and 4A illustrate keys 36 in the programmable first position within passageways 31, and FIGS. 3B and 4B illustrate a key in the locked second position within the passageways.

To insert a key into a passageway 31 to its programmable first position, the key is pushed downwardly into a passageway with a relatively moderate amount of force. As a key is inserted into a passageway, the reduced diameter portion **31*b* of the passageway compresses spring legs 71 inwardly to permit retention portion 69 to enter into the passageway. Insertion is able to continue until ribs 73 on the ribbed section of retention portion 69 (which defines an outside diameter slightly greater than the diameter of reduced diameter portion 31*b* of passageway 31) impinge upon top surface 32 of housing 21 to oppose further insertion of the key. Also, as insertion progresses, outwardly extending barbs 72 on legs 71 clear the reduced diameter passageway portion 31*b* of passageway 31 and entered larger diameter passageway portion 31*a*. At that time, legs 71 spring outwardly and barbs 72 thereafter cooperate with annular, internal shoulder 33 in passageway 31 to oppose withdrawal of the key from the passageway. Thus, barbs 72 and ribs 73 on key 56 cooperate with internal shoulder 33 of passageway 31 and outer surface 32 of housing 21, respectively, to define a first retention means for loosely retaining key 36 in the programmable first position partially inserted into passageway 31. While in the programming position, however, key 36 can be rotated to position the keying portion 68** of the key in a selected orientation.

After key 36 has been rotated to orient the keying portion 68 thereof, the key is then pushed fully into passageway 31 with a more substantial force to lock the key in the passageway in the locked second position. The more substantial force overcomes the resistance of the ribs against the outer surface 32 of the housing allowing the ribs to enter into passageway 31. The ribbed section of the key is received within reduced diameter portion **31*b* of passageway 31** with an interference fit to firmly retain the key within the passageway and to thereafter prevent removal of the key from the passageway.

As shown in FIG. 3A, when key 36 is in the programming position, body portion 67 thereof is aligned with upper, parallel surface portions **82*a* of key location features 81. Surfaces 82*a* are spaced sufficiently apart to permit the key to be freely rotated to the selected orientation. In this position also, keying portion 36 extends above the top of the key location features to permit the keying portion to be easily received in a hand tool or the like to rotate the key. When the key is fully inserted into passageway 31, however, as shown in FIG. 3B, body portion 67 is aligned with parallel surface portions 82*b* of features 81. Surfaces 82*b* are positioned more closely together and receive body portion 67 therebetween with a rather close fit to prevent rotation of body portion 67 and of the key in general when the key is in the locked second position. Thus, when key 36 is in the locked second position, the interference fit between the ribbed section of the key and the sidewall of passageway portion 31*b*, and the cooperation between the polygonal body portion of key 36 and surfaces 82*b* of features 81** define second retention means for retaining the key in the locked second position in the passageway.

Figure 6:
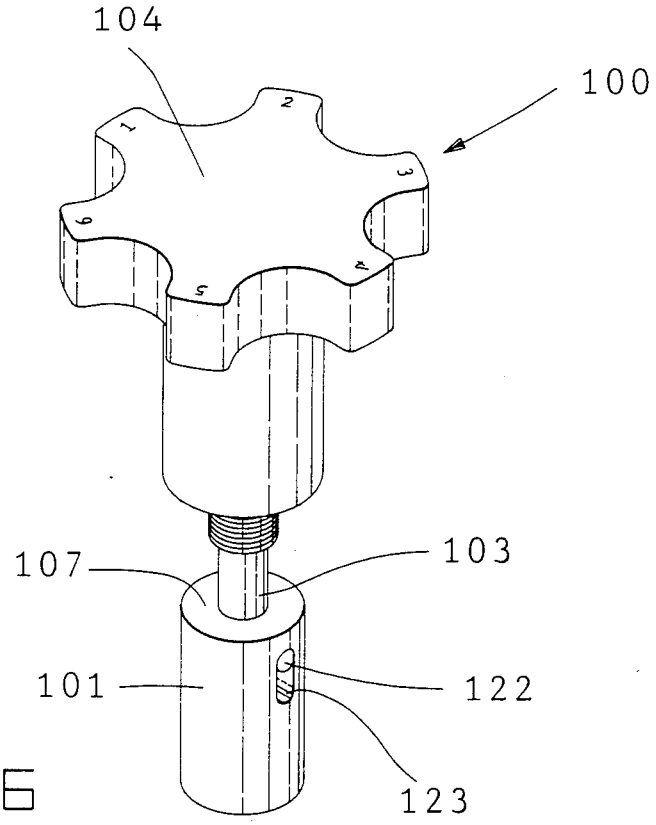
FIG. 6 is a perspective view of a key orienting and seating tool according to a presently preferred embodiment of the invention.
Figure 7:
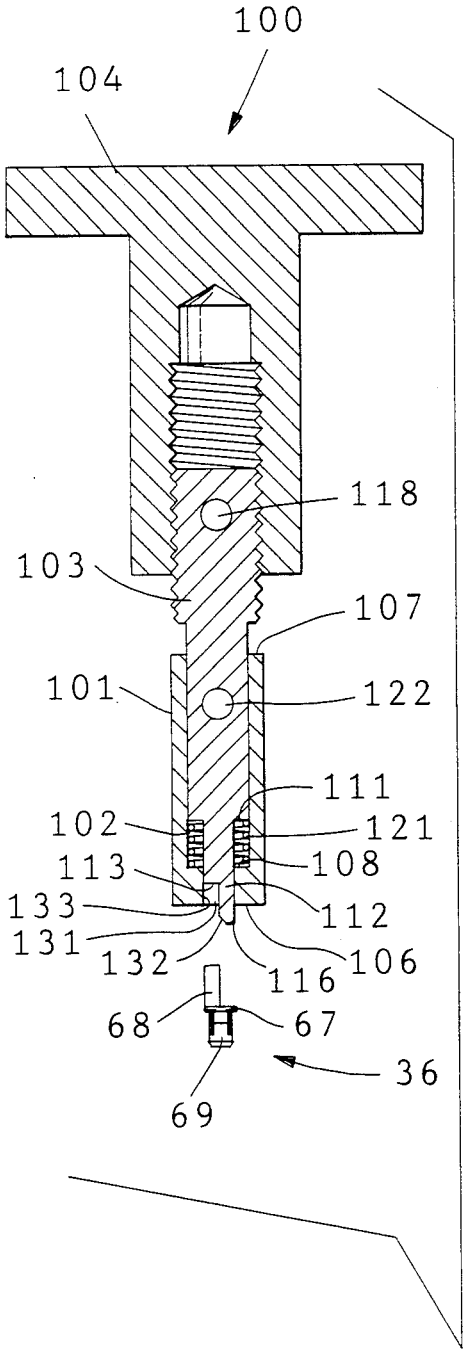
FIGS. 7 and 8 are cross-sectional views of the tool of FIG. 6 in retracted and extended positions, respectively.
Figure 8:
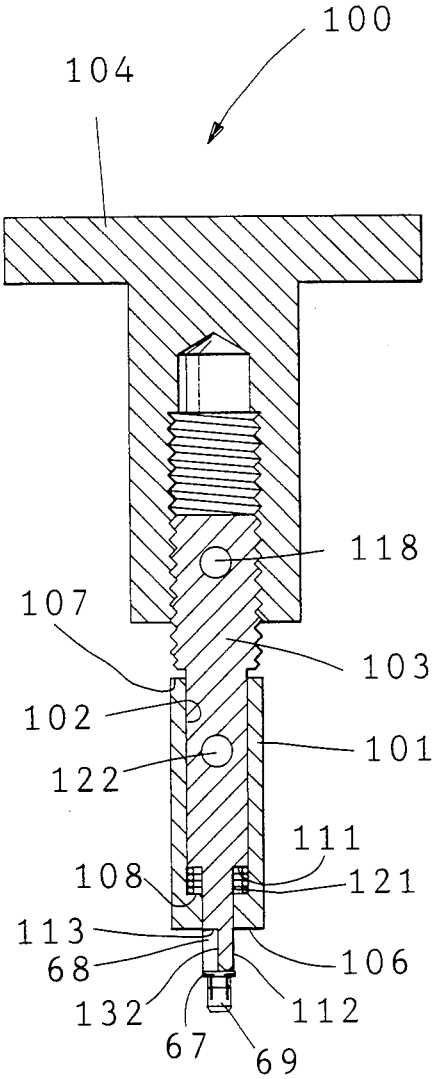

FIGS. 6–8 illustrate a tool according to the present invention for orienting a key 36 while it is in its programmable first position within key receiving passageway 31, and for thereafter fully inserting the key into the passageway to its locked second position. The tool is generally designated by reference numeral 100 and is composed of a tubular-shaped sleeve 101 having an axial bore 102; an elongated cylindrical member 103 supported within sleeve 101; and a handle 104 attached to cylindrical member 103. The components can be constructed of steel or other suitable material.

Bore 102 of sleeve 101 extends from forward end face 106 to rear face 107 and includes a portion of reduced diameter adjacent its forward end to define a rearwardly facing, internal annular shoulder 108. Member 103 is of generally cylindrical shape and is sized so as to be capable of sliding longitudinally within bore 102. Member 103 includes a cylindrical portion of slightly reduced diameter adjacent the front end thereof to define a forwardly-facing shoulder 111 thereon. Member 103 also includes an extended portion 112 extending from the front face 113 thereof Which is of generally semi-circular cross-section. Extended portion 112 defines a forwardly-facing surface 116.

As shown in FIGS. 7 and 8, cylindrical member 103 is adapted to extend through sleeve 101. A portion of the cylindrical member extends outwardly from rear face 107 of sleeve 101 and is adapted to be secured to handle 104 by, for example, screw 118 and/or by being threaded thereto.

Cylindrical member 103 is supported within sleeve 101 by resilient means, such as a spring 121 illustrated schematically in FIGS. 7 and 8. Spring 121 is positioned within sleeve 101 such that one end thereof bears against rearwardly-facing shoulder 108 on sleeve 101 and the opposite end bears against forwardly-facing shoulder 111 on cylindrical member 103. Spring 121 normally urges the cylindrical member to the position illustrated in FIG. 7 in which the cylindrical member is substantially retracted into sleeve 101 in a retracted first position (with only a small portion of extended portion 112 of member 103 extending beyond forward end face 106 of sleeve 101), but permits relative longitudinal movement of the cylindrical member relative to the sleeve, as will be explained hereinafter.

Cylindrical member 103 is also connected to sleeve 101 by a pin 122 which extends through an elongated slot 123 in the sleeve as shown in FIG. 6. The pin an slot arrangement permits relative axial movement between cylindrical member 103 and sleeve 101 but prevents relative rotation therebetween.

Tool 100 is used to orient and then seat the keys 36 of connector 10. Initially, when a key 36 is in its programmable first position (as shown in FIGS. 1, 3A and 4A), the tool is positioned over the key such that the extended portion 68 of the key is received in the space 131 (FIG. 7) that is defined between the side-facing, flat surface 132 of semi-circular, extended portion 112 of cylindrical member 103 and the sidewall 133 of the reduced diameter portion of bore 102. When the extended portion of the key is properly positioned in space 131, the tool is rotated about its axis, and surface 132 functions as a first bearing surface bearing against the extended portion 68 of key 36 to rotate the key to a desired orientation.

As shown in FIG. 6, suitable indicia is provided on the tool, preferably on handle 104, to assist in identifying the desired orientation of the key.

After the key is rotated to a desired orientation, handle 104 is then simply pushed down to press the oriented key fully into connector passageway 31 to lock the key in the locked second position within the passageway. As the handle is pushed down, forward-facing surface 106 of sleeve 101 bears against the outer surface 32 of the connector and is prevented from moving forward. Cylindrical member 103, however, moves forward to an extended second position illustrated in FIG. 8, to push the key into its locked second position. Forwardly facing surfaces 113 and/or 116 function as second bearing surfaces pressing against the key to push the key into the passageway to its locked second position. Following seating of the key, the tool is removed and spring 121 urges the cylindrical member back to its retracted first position illustrated in FIG. 7.

Tool 100 provides a convenient means for quickly and accurately orienting and then seating key 36 into connector passageway 31. The tool is simple in design but is highly effective and avoids the need for manual orientation and seating of the key.

While what has been described constitutes a presently preferred embodiment of the invention, it should be recognized that the invention could take numerous other forms. Accordingly, it should be understood that the invention is to be limited only insofar as is required by the scope of the following claims.

I claim:

1. A tool for orienting and seating a programmable key in an electrical connector, said key having an extended keying portion and being rotatable to position said keying portion at any selected one of a plurality of orientations, and thereafter being insertable into a key-receiving passageway in said connector, said tool comprising:

a sleeve having a bore extending thereinto from a forward end face thereof;

a substantially rigid member positioned within said bore, said member including means at its forward end for defining a space for receiving said extended keying portion of said key;

means for coupling said substantially rigid member to said sleeve for permitting axial movement of said member relative to said sleeve while preventing relative rotation between said member and said sleeve, means for rotating said substantially rigid member and said sleeve coupled thereto when the extended keying portion of said key is received within said space for rotating said key to a selected orientation; and means for thereafter moving said substantially rigid member axially forward relative to said sleeve for inserting said oriented key into said key-receiving passageway.

2. The tool of claim 1 wherein said rotating means and said means for moving said substantially rigid member axially forward relative to said sleeve includes a handle connected to said substantially rigid member.

3. The tool of claim 1 and further including indicia on said tool for identifying the orientations to which said key is rotated.

4. A tool for orienting and seating a programmable key in a electrical connector, said key having an extended keying portion and being rotatable to position said keying portion at any selected one of a plurality of orientations, and thereafter being insertable into a key-receiving passageway in said connector to lock said key in said selected orientation, said tool comprising:

a sleeve having a cylindrical bore extending thereinto from a forward end face thereof;

a cylindrical member positioned within said bore, said cylindrical member having an extended portion of generally semi-circular cross-section at its forward end for defining a generally semi-circular space between the extended portion and the sidewall of the bore for receiving said extended keying portion of said key when said member is in a retracted first position within said sleeve;

means connecting said sleeve to said cylindrical member for preventing relative rotation between said member and said sleeve; and resilient means coupling said member to said sleeve for permitting axial movement of said member relative to said sleeve from said retracted first position to an extended second position in which said extended portion of said member extends substantially beyond said forward end face of said sleeve, wherein said key is rotated to said selected orientation by rotating said tool with said extended keying portion of said key received in said space when said member in said retracted first position, and wherein said key is thereafter inserted into said key-receiving passageway to lock said key in said selected orientation by moving said member axially forward relative to said sleeve from said retracted first position to said extended second position.

5. The tool of claim 4 and further including a handle connected to said cylindrical member for rotating said tool and for moving said cylindrical member from said retracted first position to said extended second position.

6. The tool of claim 5 and further including indicia on said handle for identifying the orientations to which said key is rotated.

7. The tool of claim 4 wherein said resilient means normally urges said cylindrical member to said retracted first position.

8. A tool for orienting and seating a programmable key in an electrical connector, said key having an extended keying portion and being rotatable to position said keying portion at any selected one of a plurality of orientations, and thereafter being insertable into a key-receiving passageway in said connector, said tool comprising:

a sleeve having a bore extending thereinto from a forward end face thereof;

a substantially rigid member positioned within said bore, said substantially rigid member including an extended portion of reduced cross-sectional area extending from the forward end thereof for defining a space between the sidewall of said bore and said extended portion of said member for receiving said extended keying portion of said key;

means for rotating said member whereby said key is rotated to a selected orientation when the extended keying portion of said key is received in said space; and means for coupling said member to said sleeve while permitting axial movement of said member relative to said sleeve whereby said key is inserted into said key-receiving passageway by moving said member axially forward relative to said sleeve.

9. The tool of claim 8 wherein said rotating means includes means for preventing relative rotation between said member and said sleeve, wherein said bore comprises a generally cylindrical bore and said member comprises a generally cylindrical-shaped member slidable within said bore, and wherein said extended portion of said member has a substantially flat, side facing, first bearing surface for bearing against said extended keying portion received in said space for rotating said key when said tool is rotated.

10. The tool of claim 9 wherein said extended portion of said member is of generally semi-circular cross-section.

11. The tool of claim 9 wherein said relative rotation preventing means comprises a longitudinal slot in said sleeve and a pin extending through said slot and connected to said member.

12. A tool for orienting and seating a programmable key in an electrical connector, said key having an extended keying portion and being rotatable to position said keying portion at any selected one of a plurality of orientations, and thereafter being insertable into a key-receiving passageway in said connector, said tool comprising:

a sleeve having a bore extending thereinto from a forward end face thereof;

a substantially rigid member positioned within said bore, said member including means at its forward and for defining a space for receiving said extending keying portion of said key;

means for rotating said member whereby said key is rotated to a selected orientation when the extended keying portion of said key is received in said space; and means for coupling said member to said sleeve while permitting axial movement of said member relative to said sleeve whereby said key is inserted into said key-receiving passageway by moving said member axially forward relative to said sleeve, said coupling means comprising resilient coupling means for permitting axial movement of said member relative to said sleeve between a retracted first position for rotating said key and an extended second position for inserting said key into said key-receiving passageway.

13. The tool of claim 12 wherein said resilient coupling means comprises spring means which normally urges said member to said retracted first position.

14. The tool of claim 13 wherein a forwardly facing surface of said member comprises a second bearing surface bearing against said key for inserting said key into said key-receiving passageway.

15. The tool of claim 1 wherein said coupling means comprises a longitudinal slot in said sleeve and a pin connected to said member and extending through said slot.

* * * * *